US006251006B1

(12) United States Patent
Laborde et al.

(10) Patent No.: US 6,251,006 B1
(45) Date of Patent: Jun. 26, 2001

(54) DEVICE FOR DYNAMIC SEPARATION OF TWO ZONES

(75) Inventors: Jean-Claude Laborde, Les Ulis; Victor Manuel Mocho, Montrevil, both of (FR)

(73) Assignees: Commissariat a l'Energie Atomique; UNIR Ultra propre Nutrition Industrie Recherche, both of Paris (FR)

( * ) Notice: Subject to any disclaimer, the term of this patent is extended or adjusted under 35 U.S.C. 154(b) by 0 days.

(21) Appl. No.: 09/331,196

(22) PCT Filed: Dec. 24, 1997

(86) PCT No.: PCT/FR97/02428

§ 371 Date: Jun. 25, 1999

§ 102(e) Date: Jun. 25, 1999

(87) PCT Pub. No.: WO98/29696

PCT Pub. Date: Jul. 9, 1998

(30) Foreign Application Priority Data

Dec. 27, 1996 (FR) ..... 96 16100

(51) Int. Cl.[7] ..... F24F 9/00
(52) U.S. Cl. ..... 454/190; 454/189
(58) Field of Search ..... 454/56, 189, 190, 454/191

(56) References Cited

U.S. PATENT DOCUMENTS

| | | | | |
|---|---|---|---|---|
| 3,023,688 | * | 3/1962 | Kramer, Jr. | 454/190 |
| 5,145,459 | * | 9/1992 | Meline et al. | 454/190 |
| 5,312,294 | * | 5/1994 | Meline | 454/190 X |
| 5,934,992 | * | 8/1999 | Sohier et al. | 454/190 |

FOREIGN PATENT DOCUMENTS

| | | | | |
|---|---|---|---|---|
| 0 099 818 | | 2/1984 | (EP) . | |
| 0 447 314 | * | 9/1991 | (EP) . | |
| 2 530 163 | | 1/1984 | (FR) . | |
| 2-116794 | * | 5/1990 | (JP) | 454/190 |
| 91/05210 | * | 4/1991 | (WO) . | |
| 96/24011 | * | 8/1996 | (WO) . | |

* cited by examiner

*Primary Examiner*—Harold Joyce
(74) *Attorney, Agent, or Firm*—Oblon, Spivak, McClelland, Maier & Neustadt, P.C.

(57) ABSTRACT

A device for dynamically separating two zones by a bufer zone and two clean air curtains. When transferring objects at high speed between two zones, a buffer zone which is connected to the two zones, forms a dynamic lock in order to separate them. a dynamic confinement system placed between each pair of adjacent communication zones forms an air curtain including two or three clean air jets. The buffer zone includes a blower ceiling and an intake grill facing it.

10 Claims, 2 Drawing Sheets

DEVICE FOR DYNAMIC SEPARATION OF TWO ZONES

BACKGROUND OF THE INVENTION

1. Field of the Invention

This invention relates to a device used to dynamically separate at least two zones in which there are different environments, to enable objects or products to be transferred from one zone to the other at high speed without breaking the confinement.

The process according to the invention may be used in many industrial sectors.

Thus, this process is applicable to all industries (food processing, medical, biotechnologies, high technologies, nuclear, chemical, etc.) in which different environments have to be maintained in zones communicating with each other to enable frequent passage of objects or products. The term "environment" refers particularly to aeraulic conditions, gaseous and particular concentrations, temperature, relative humidity, etc.

2. Discussion of the Background

At the present time, there are two types of solutions for dynamically separating two zones communicating with each other, for example in order to allow objects to be brought in and out; these two types are protection by ventilation and protection by air curtain.

Protection by ventilation consists of artificially creating a pressure difference between the two zones so that the pressure in a zone to be protected is greater than the pressure inside a contaminating zone. Thus, if the zone to be protected contains a product that could be contaminated by ambient air, a laminar flow is injected into the zone to be protected that blows outwards through the access opening to this separation zone. In the opposite case in which personnel and the environment outside a contaminated space need to be protected, dynamic confinement is achieved by using extraction ventilation in this contaminated space. In each case, an empirical rule imposes a minimum ventilated air speed of 0.5 m/s in the plane of the opening through which the two zones communicate in order to prevent contamination from being transferred into the zone to be protected.

However, the efficiency of this ventilation protection technique is not perfect, particularly in a so-called "infractions" situation, in other words when objects are transferred between the two zones. Furthnermore, this type of protection makes it necessary to process and control the entire zone to be protected ron the contaminating external atmosphere or the entire contaminated zone. When the zone to be processed and controlled is large, this introduces a particularly high investment and operating cost. Finally, this technique of protection by ventilation only provides protection in one direction, in other words it is onlv useful when contamination transfers are only possible in one direction.

The air curtain protection technique consists of simultaneously injecting one or several adjacent clean air jets in the same direction into the separation zone between the two zones, which form an immaterial door between the zone to be protected and the contaminating zone.

Note that according to the theory of turbulent plane jets, a plane air jet is composed of two separate zones; a transition zone (or core zone) and a development zone.

The transition zone corresponds to the central part of the jet adjacent to the nozzle in which clean air is injected. Within this zone in which there is no mix between the injected air and the air on each side of the jet, the speed vector is constant. Considering a cross-section through a plane perpendicular to the plane of the separation zone, the width of the transition zone gradually decreases as the distance from the nozzle increases. This is why this transition zone is called a "tongue" throughout the rest of the text.

The-development zone of the jet is the part of this jet located outside the transition zone. In this jet development zone, outside air is entrained by the jet low. This results in variations in the speed vector and mixing of air. Air entrainment on both surfaces of the jet within this development zone is called "induction". Thus an air jet induces an air flow on each of its surfaces which depends particularly on the injection flow of the jet considered.

Documents FR-A-2 530 163 and FR-A-2 652 520 propose an air curtain to separate a polluted zone from a clean zone. in both cases, the air curtain consists of twio adjacent clean air jets blowing in the same direction. Nllore precisely, dynamic separation is provided by a first relatively slow jet (called the "slow jet"), for which the tongue entirely covers the opening. The second jet (called the "fast jet") is faster than the slow jet, and is installed between the slow jet and the zone. Its function is to stabilize the slow jet by a suction effect which brings this slow jet into contact with the fast jet.

In these documents, it is specified that the tongue of the slow jet is sufficiently long to cover any opening when the width of the slow jet injection nozzle is equal to at least $1/6^{th}$ of the height of the opening to be protected.

Document FR-A-2 652 520 also proposes to simultaneously inject clean ventilation air at a temperature adapted to the requirements, inside the clean zone to be protected. Note that this clean ventilation air must be injected at a rate approximately equal to the rate induced by the surface of the fast jet which is in contact with clean ventilation air.

Furthermore, document FR-A-2 659 782 proposes to add a third relatively slow clean air jet to the two clean air jets used in documents FR-A-2 530 163 and FR-A-2 652 520 so that the fast jet is located between two adjacent slow jets in the same direction. The flow of clean ventilation air injected inside the zone to be protected is then considerably reduced due to the fact that induction in this zone is produced by the development zone of one of the slow jets, rather than by the development zone of the fast jet as in the case of an air curtain with two jets. Furthermore, dynamic confinement is provided in both directions, which was not the case in the previous documents.

Document WO-A-96 241011 also describes an installation in which a chamber containing a confined atmosphere, communicates with the same outside atmosphere through one or two openings, with which gas curtains are associated. Each gas curtain is formed of a slow jet sustained by a fast jet as described in documents FR-A-2 530 163 and FR-A-2 652 520. The chamber can be used for continuous processing of products due to the injection of a reagent inside it. Products pass from the outside atmosphere into the confined atmosphere in this chamber to be processed in it before being taken out again to the external atmosphere.

Despite the improvements made to the air curtain technique described in these various documents, the problem of transferring objects or products at a high rate between two zones in which there are different environments without breaking the confinement has not been satisfactorily solved by any known device, particularly if there is a risk of cross-contamination between the two zones.

SUMMARY OF THE INVENTION

More particularly, the purpose of the invention is a device for dynamic separation of at least two zones in which there are different environments authorizing high speed transfer of objects or products between these zones, without breaking the confinement, even in the case in which there is a risk of cross-contamination between the two zones.

According to the invention, this result is obtained by means of a dynamic separation device separating at least two zones in which there are different environments, characterized by the fact that it comprises:

at least one buffer zone with controlled atmosphere used for communication between the zones to be separated;

dynamic confinement means placed between each pair of adjacent communicating zones to create an air curtain between these zones comprising a first relatively slow clean air jet which comprises a tongue which completely closes off communication between the zones, and a second relatively fast clean air jet in the same direction as the first jet and adjacent to it, on the side of the buffer zone.

The expression "with controlled atmosphere" means that all characteristics of the air present in the buffer zone such as temperature, relative humidity, aeraulic conditions, gaseous and particular concentrations, etc., are controlled.

The expression "adjacent communicating zones" means each group of two zones in the assembly formed by the zones to be separated and by the buffer zones, that communicate directly with each other. Thus in the case in which the device comprises a single buffer zone located between two zones to be separated, there are two pairs of adjacent communicating zones each formed by the single buffer zone and one of the zones to be separated. When there are several buffer zones, there is at least one other pair of adjacent communicating zones formed of two buffer zones.

The arrangement consisting of one of several buffer zones between the zones to be separated, and air curtains formed from at least two jets of clean air between adjacent communicating zones, enable objects or products to be transferred at high speed while preventing contaminants present in either of the controlled environment zones from reaching the other controlled environment zone, and vice versa. Each buffer zone thus acts as a dynamic lock between the zones to be separated.

Preferably, the dynamic confinement means that are inserted between each pair of adjacent communicating zones are such that the second (fast) jet in each air curtain is injected at a flow such that the air flow induced by the surface of the second jet in contact with the first (slow) jet is less and preferably approximately equal to half the first jet injection rate.

In one special embodiment, these dynamic confinement means are such that each air curtain comprises a relatively slow third jet in the same direction as the first and second jets and adjacent to the second (fast) jet on the same side as the buffer zone. This third jet then comprises a tongue that completely closes off communication between the zones and it is injected at a flow significantly equal to the injection flow in the first jet, so that the air flows induced by the surfaces of the second jet in contact with the first and third jets respectively are less than, or preferably approximately equal to half of the injection flows of the jets.

In practice, each of the dynamic confinement means comorises at least two adjacent air supply nozzles and an intake grille facing the supply nozzles and located in a plane parallel to them. The supply nozzles and the intake grilles are advantageously located in line with the upper and lower surfaces of the buffer zone.

In order to further improve the behavior of the device particularly in infraction situations through air curtains, the buffer zone preferably comprises ventilation, such as a blower ceiling, associated with the injection means that inject clean air into this zone. The flow from these injection means is then equal to at least the sum of the air flows induced by each of the surfaces of the jets in the air curtains in contact with the buffer zone. Furthermore, the flow from the injection means is such that it provides a minimum speed of 0.1 m/s across the areas of the planes at the ends of the buffer zone.

In this case, the buffer zone may also comprise an intake grille distributed over its entire lower surface. The flow from the injection means is then equal to at least the sum of the air flow drawn in by the intake grille and the air flow induced by each of the surfaces of the air curtain jets in contact with the buffer zone. Furthermore, the flow from the injection means must always be sufficient to provide a minimum speed of 0.1 m/s across the areas of the planes at the ends of the buffer zone. This arrangement corresponds particularly to the case in which the buffer zone is used to carry out an elementary operation (proportioning, packaging, etc.) on objects or products transferred between the zones to be separated.

In the latter case, several buffer zones may be placed in series between the zones to be separated. The air curtains inserted between the two buffer zones are then delimited by side walls with a width equal to the width of the adjacent air supply nozzles.

Furthermore, regardless of the number of buffer zones used on the device, the air curtains inserted between a buffer zone and one of the zones to be separated are delimited by side walls with a width equal to at least the maximum thickness of these air curtains.

BRIEF DESCRIPTION OF THE DRAWINGS

We will now describe some non-limitative examples of different embodiments of the invention with reference to the attached drawings in which.

DETAILED DESCRIPTION OF THE PREFERRED EMBODIMENTS

Figure 1:
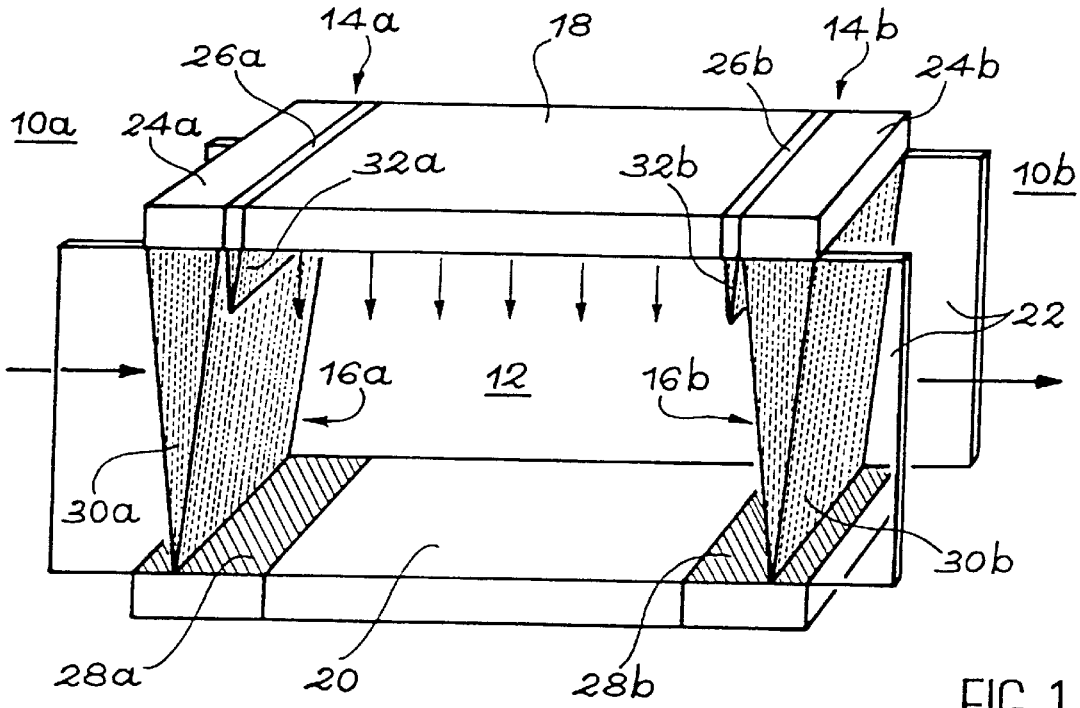
FIG. 1 is a perspective view that diagrammatically illustrates the use of a single buffer zone to provide communication between two zones with controlled environments through two air curtains each formed of two adjacent clean air jets according to a first embodiment of the invention.

FIG. 1 shows two zones denoted by reference 10*a* and 10*b*, in which there are different environments and in which it is required to be able to transfer objects or products at high speed in at least one direction. These zones 10*a* and 10*b* are called the "zones to be separated" or "zones with controlled environments" throughout the rest of this text. For example, it is assumed non-restrictively that objects or products must be transferred at high speed from zone 10*a* to zone 10*b*.

Zones 10*a* and 10*b* are delimited by air tight surfaces (not shown) and the environment in each zone is different, in other words at least one of the characteristics, specifically such as gaseous and particular concentrations, aeraulic conditions, temperature, relative humidity, etc. is different in the two zones.

According to the invention, zones 10*a* and 10*b* are linked to each other through at least one dynamic separation system which, in the embodiment shown in FIG. 1, includes a buffer zone 12 through which zones 10*a* and 10*b* communicate. More precisely, the buffer zone 12 is a zone with a controlled atmosphere, in other words a zone in which various parameters such as gaseous and particular concentrations, aeraulic conditions, temperature, relative humidity, etc., are controlled.

The dynamic separation device according to the invention also comprises dynamic confinement means denoted in general by references 14*a* and 14*b* on FIG. 1, which are inserted between zone 10*a* and buffer zone 12, and between buffer zone 12 and zone 10*b* respectively, in other words eacn pair of adjacent communicating zones in the installation.

Dynamic confinement means 14*a* create a first air curtain 16*a* between zone 10*a* and buffer zone 12. imilarly, dynamic confinement means 14*b* create a second air curtain 16*b* between buffer zone 12 and the zone 12*b* with controlled environment.

As illustrated diagrammatically in FIG. 1, the buffer zone 12 is delimited by air tight surfaces in order to form a horizontal corridor with a rectangular cross-section, the ends of which lead into zone 10*a* and into zone 10*b* through air curtains 16*a* and 16*b* created by dynamic confinement means 14*a* and 14*b*.

The upper horizontal surface of the buffer zone 12 forms a blower ceiling 18. This blower ceiling 18 is associated with injection or ventilation means (not shown) that output clean air to the buffer zone 12 at a determined flow. As will be seen later, this flow depends on the characteristics of the air curtains 16*a* and 16*b* and whether or not there is an intake grille in buffer zone 12.

In the embodiment shown in FIG. 1, the horizontal lower surface 20 of the buffer zone 12 forms a working plane. As a variant, an intake grille may be distributed over this entire lower surface 20, to recover part of the ventilation air flow injected into buffer zone 12 through the blower ceiling 18.

In addition to its upper horizontal surface that forms the blower ceiling 18 and its lower horizontal surface 20, the buffer zone 12 is delimited by two side walls 22, also oriented vertically parallel to the plane of FIG. 1.

The dynamic confinement means 14*a* and 14*b* are placed in line with the air tight walls that delimit the buffer zone 12 so as to form the air curtains 16*a* and 16*b* when these confinement means are used.

More precisely, in the embodiment shown in FIG. 1, dynamic confinement means 14*a* and 14*b* are designed to create air curtains 16*a* and 16*b* each of which are formed of two clean air jets adjacent to each other and in the same direction. Consequently, dynamic confinement means 14*a* comprise two air supply nozzles 24*a* and 26*a* that extend across the entire width of buffer zone 12 in line with the blower ceiling 18 on the zone 10*a* side. Similarly, dynamic confinement means 14*b* comprise two air supply nozzles 24*b* and 26*b* that extend across the entire width of buffer zone 12 in line with the blower ceiling 18 on the zone 10*b* side. All air supply nozzles 24*a*, 26*a*, 24*b* and 26*b* output into the same horizontal plane located in line with the lower surface of the blower ceiling 18.

The dynamic confinement means 14*a* also comprise a horizontal intake grille 28*a* located on the surface of the air supply nozzles 24*a* and 26*a* and extend over the entire width of buffer zone 12, in line with its lower surface 20. Similarly, dynamic confinement means 14*b* comprise a horizontal intake grille 28*b* placed below the air supply nozzles 24*b* and 26*b* and extending over the entire width of buffer zone 12, in line with its lower surface 20.

Each of the dynamic confinement means 14*a* and 14*b* also comprises means (not shown) of injecting air at a controlled speed and flow through the air supply nozzles 24*a* and 26*a*, and through the air supply nozzles 24*b* and 26*b* respectively, and means (not shown) of drawing in all air flows injected through the nozzles and induced air flows, through intake grilles 28*a* and 28*b* respectively.

As shown diagrammatically in FIG. 1, the air tight side walls 22 that delimit the buffer zone 12 extend beyond the ends of this zone over a length equal to at least the maximum thickness of the air curtains 16*a* and 16*b*, in order to avoid any break in the confinement at the sides of air curtains.

As already mentioned, the embodiment in FIG. 1 corresponds to the case in which each air curtain 16*a* and 16*b* is formed of two adjacent clean air jets in the same direction. The two air curtains 16*a* and 16*b* have exactly the same characteristics which will now be described in more detail.

When the dynamic confinement means 14*a* and 14*b* are used, each of the air supply nozzles 24*a* and 24*b* outputs a relatively slow clean air jet, for which only tongues 30*a* and 30*b* are shown. Furthermore, each of the air supply nozzles 26*a* and 26*b* located on the same side of the blower ceiling as the nozzles 24*a* and 24*b* outputs a relatively fast clean air jet compared with the jets output by nozzles 24*a* and 24*b*. FIG. 1 only shows the tongues 32*a* and 32*b* of these relatively fast jets. To simplify the description, the relatively slow and relatively fast jets are called "slow jets" and "Last jets" in the rest of the text.

Since the air supply nozzles 24*a*, 26*a*, 24*b* and 26*b* extend over the entire width of the buffer zone 12, the air curtains 16*a* and 16*b* also extend over the entire width of the burrer zone between the buffer zone side walls 22.

As shown diagrammatically in Iigure 1, each of the slow jets injected by nozzles 24*a* and 24*b* is sized such that its tongue 30*a*, 30*b* covers tne entire cross-section of the buffer zone at the ends of the buffer zone adjacent to zones 10*a* and 10*b* respectively. This result is obtained by making sure that the range, or length, of the tongues 30*a* and 30*b* is at least as long as the height of the buffer zone 12. This is achieved by making the width of the injection slit for each nozzle 24*a* and 24*b* parallel to the plane of the figure equal to at least $1/6^{th}$ and preferably $1/5^{th}$ of the height of the buffer zone 12.

Furthermore, the speed of each of the slow jets emitted by nozzles 24*a* and 24*b* is advantageously equal to 0.5 m/s, in order to minimize turbulence and for economic reasons. Since the length of the tongues 30*a* and 30*b* of the slow jets is equal to at least half of the height of the buffer zone 12 and since these jets are relatively slow, the air streams go around the contours of the objects or products that pass through the air curtains 16*a* and 16*b* without breaking the confinement.

However, the low speed of the slow jets injected by nozzles 24*a* and 24*b* mean that these jets, if they were alone, could be destabilized by aeraulic or mechanical disturbances that could occur close Lo the air curtains, thus breaking the confinement of zones 10*a* and 10*b*. This is why fast jets injected by nozzles 26*a* and 26*b* are added to each of the slow jets. The highest speed of these fast jets stabilizes the slow jets and consequently improves the confinement efficiency of zones 10*a* and 10*b* in infraction situations through the dynamic barriers forred by each of the air curtains 16*a* and 16*b*. As a nonrestrictive example, the width of each fast jet air supply nozzle 26*a* and 26*b* may be equal to about $1/40^{th}$ of the width of the slow jet air suoplv nozzles 24*a* and 24*b*.

Preferably, in order to optimize the barrier effect provided by air curtains 16*a* and 16*b*, the injection flow of each fast jet through nozzles 26*a* and 26*b* is adjusted such that the air flow induced by the surfaces of these fast jets that are in contact with the slow jets injected through nozzle 24*a* and 24*b* is less than, or preferably approximately equal to half of the injection flow through these slow jets.

As already noted, the intake grilles 28*a* and 28*b* recover the entire air blown through the supply nozzles under which they are placed, and all entrained air by each air curtain 16*a* and 16*b*. In practice, air recovered through intake grilles 28*a* and 28*b* may be purified by specific purification means (not shown) before being recycled to air supply nozzles 24*a*, 26*a*; 24*b*, 26*b*. Excess air is then released outside after a second specific purification.

Note that the horizontal orientation of the air supply nozzles that determines a vertical orientation of the air curtains, and the horizontal arrangement of the intake grilles facing the air curtains, optimize the barrier effect obtained using each of the dynamic confinement means 14*a* and 14*b*.

Furthermore, internal ventilation of the buffer zone 12 provided by the blower ceiling 18 produces a purifying effect in this zone. This purifying effect contributes to the efficiency of the dynamic separation of zones 10*a* and 10*b*, particularly in the case of a high transfer rate of objects or products between these two zones.

More precisely, in the embodiment shown in FIG. 1 in which each of the air curtains 16*a* and 16*b* is formed of two adjacent jets in the same direction, the clean ventilation air flow injected in the buffer zone 12 through the blower ceiling 18 is equal to at least the air flow induced by the fast jets output from nozzles 26*a* and 26*b*, on the surfaces of these fast jets that are in contact with the buffer zone 12. Furthermore, the clean ventilation air is injected into the buffer zone 12 through the blower ceiling 18 at a speed such that the air speed across the areas of the planes at the ends of the buffer zone 12 that lead into zones 10*a* and 10*b*, is equal to at least 0.1 m/s.

Furthermore, note that the physical characteristics (temperature, relative humidity, gaseous and particular concentrations, etc.) are controlled by appropriate means (not shown), so as to establish and maintain a determined atmosphere in Lhe buffer zone 12. This atmosphere may be identical to the atmosphere in one of the two zones 10*a* and 10*b*, or it may be different from this atmosphere, depending on the application being considered.

Each of the intake grilles 28*a* and 28*b* has a width approximately equal to the total width of the air supply nozzles 24*a* and 26*a*, and 24*b* and 26*b* respectively. However this width may be varied, particularly to take account of some aeraulic conditions in zones 10*a* and 10*b*, tending to deviate the jets forming the air curtains 16*a* and 16*b* from the vertical. Thus, it is desirable to reduce the width of the corresponding intake grille towards the inside of buffer zone 12, When the jets forming the air curtain Lend to be deviated towards the outside of this zone. Conversely, the width of the intake grille must be increased towards the inside of the buffer zone 12 when the jets forming the air curtain tend to be deviated towards the inside of this zone.

Figure 2:
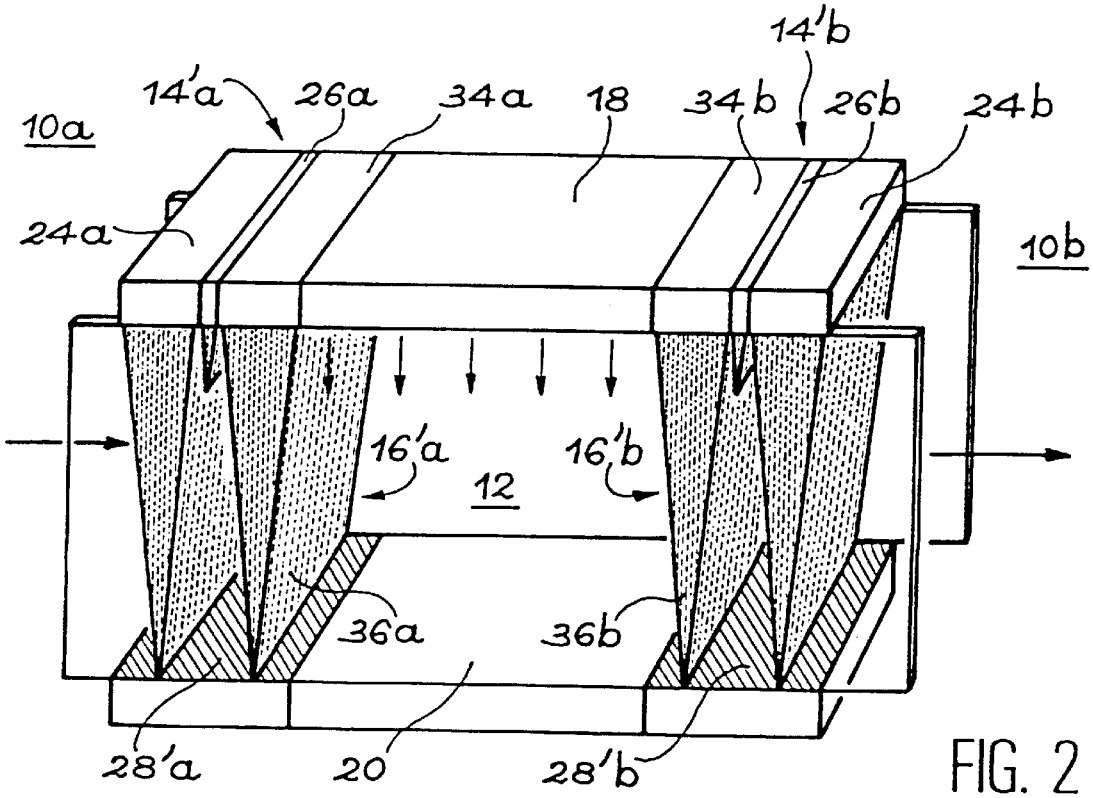
FIG. 2 is a perspective view comparable to FIG. 1 which illustrates the case in which each air curtain is formed of three adjacent clean air jets according to a second embodiment of the invention.

FIG. 2 illustrates a second embodiment of the invention which is essentially different from the embodiment in FIG. 1 due to the fact that each air curtain denoted by references 16'*a* and 16'*b* comprises three jets of adjacent clean air in the same direction.

This is achieved by providing each of the dynamic confinement means denoted by references 14'*a* and 14'*b*, in addition to the air supply nozzles 24*a*, 26*a* and 24*b* and 26*b* respectively, with a third supply nozzle 34*a* and 34*b* adjacent to nozzles 26*a* and 26*b* respectively on the side of the blower ceiling 18. More precisely, nozzles 34*a* and 34*b* extend over the entire width of the buffer zone 12 and their output is arranged in the same horizontal plane as the other nozzles 24*a*, 26*a*; 24*b*, 26*b*, in other words in a horizontal plane which is coincident with the plane of the lower surface of the blower ceiling 18.

When dynamic confinement means 14'*a* and 14'*b* are implemented, each of the air supply nozzles 34*a* and 34*b* outputs a third clean air jet which is relatively slow with respect to fast jets emitted by nozzles 26*a* and 26*b*, between this fast jet and the buffer zone 12. The tongues of these third jets are illustrated as 36*a* and 36*b* in FIG. 2.

The dimensions of nozzles 34*a* and 34*b* are chosen such that the tongues 36*a* and 36*b* of the third jets in each of the air curtains 16'*a* and 16'*b* cover the entire section of the buffer zone 12. Consequently, the lower slit in each of the nozzles 34*a* and 34*b* has a width equal to at least $1/6^{th}$, and preferably $1/5^{th}$ of the height of the buffer zone 12, in the cross section parallel to the plane of FIG. 2. In practice, the widths of nozzles 24*a*, 34*a* and 24*b*, and 34*b* are identical.

In the second embodiment of the invention illustrated in FIG. 2, the injection flow from the slow jets output by nozzles 34*a* and 34*b* is adjusted to be approximately equal to the injection flow from the slow jets output by nozzles 24*a* and 24*b*. Thus, the air flows induced by the surfaces of the fast jets output through nozzles 26*a* and 26*b* in contact with each of slow jets in the corresponding air curtain, are less than or preferably approximately equal to half of the injection flows in these slow jets.

As is also shown in FIG. 2, the width of each of the intake grilles 28'*a* and 28'*b* is adapted to the width of the air curtains 16'*a* and 16'*b*, so that it is approximately equal to the total width of the nozzles forming these air curtains. Obviously, this width may be varied as described previously with reference Lo FIG. 1, when the aeraulic conditions in at least one of the zones 10*a* and 10*b* tend to deviate the air curtains from the vertical.

The second embodiment that has just been described briefly with reference to FIG. 2 provides dynamic confinement in both directions between buffer zone 12 and each of zones 10*a* and 10*b*. Furthermore, the clean ventilation air flow injected through the blower ceiling 18 may be considerably reduced. The air injection flow through the blower ceiling 18 is then equal to at least the air, flows induced by the slow jets emitted through the injection nozzles 24*a* and 24*b*, on the surfaces of these jets in contact with the buffer zone 12, and it is such that it provides a minimum speed of 0.1 m/s across the areas of the planes at the ends of the buffer zone.

In the embodiments described above with reference to FIGS. 1 and 2, the buffer zone 12 is a passive zone in which no operations are carried out on objects or products that are transferred between zones 10*a* and 10*b*.

In other embodiments of the invention, the buffer zone 12 is an active zone, in other words it is used to carry out an elementary operation (proportioning, packaging, etc.) on objects or products transferred between zones 10*a* and 10*b*.

The architecture of the dynamic separation device is then identical to the architecture described above with reference to FIGS. 1 and 2. However, an intake grille is distributed over the entire lower surface 20 of buffer zone 12. The intake speed through this intake grille varies for example between about 0.1 m/s and 0.2 m/s. The internal ventilation supply flows through the blower ceiling 18 is then larger, and is equal to at least the sum of the air flows induced by each of the surfaces of the air curtains in contact with the buffer zone 12 and the intake flow through the intake grille.

Furthermore, this internal ventilation supply rate should correspond to a minimum speed of 0.1 m/s across the areas of the planes at the ends of the buffer zone.

Note that the ventilation flows through the blower ceiling 18 and the intake flows through the intake grille may be higher. However, the operating cost of the installation will then be higher.

Figure 3:
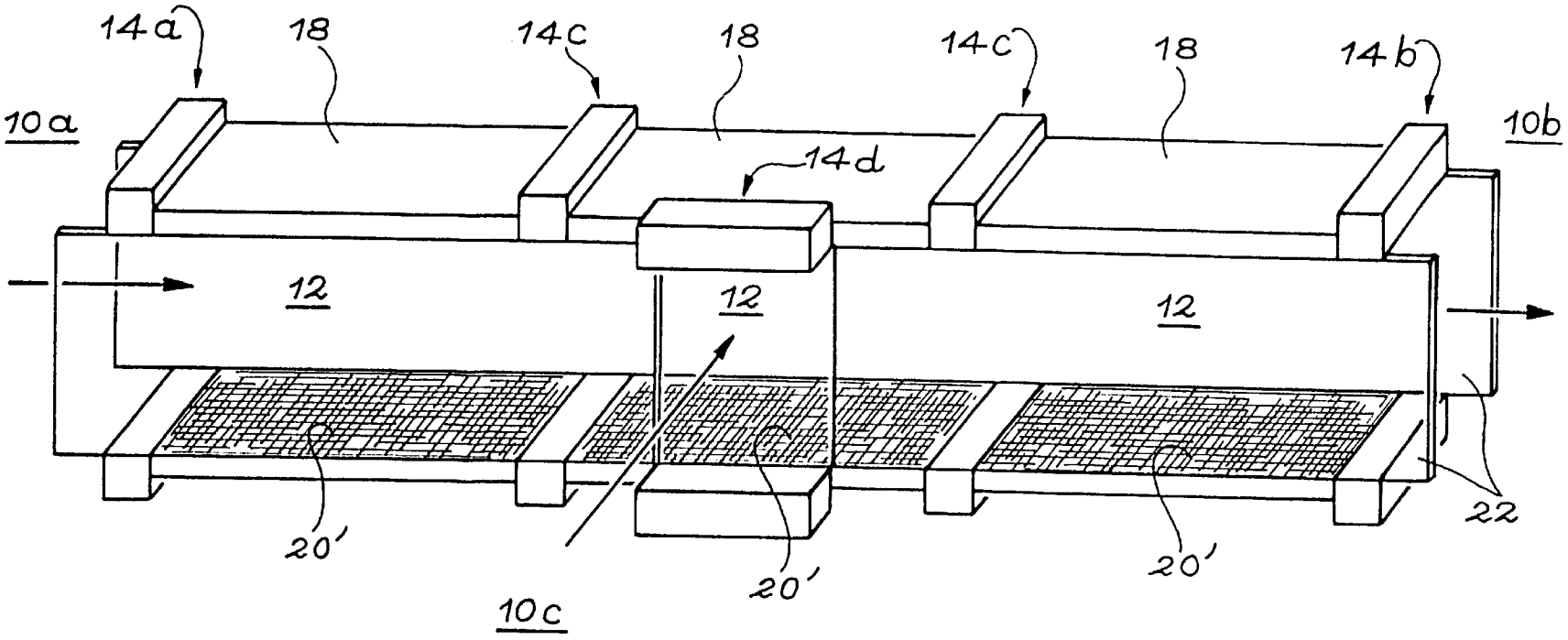
FIG. 3 is a perspective view that diagrammatically illustrates the use of several buffer zones in series between two zones with controlled environments, with the insertion of an air curtain between each pair of adjacent communicating zones.

As shown diagrammatically in FIG. 3, several successive individual operations (proportioning, packaging, etc.) may be carried out between zones 10*a* and 10*b* during the transfer of objects or products. In this case, the dynamic separation device according to the invention will comprise several buffer zones 12 laid out in series, through which zones 10*a* and 10*b* can communicate. Each buffer zone 12 then has characteristics similar to the characteristics described above, and particularly a blower ceiling 18 and an intake grille 20' facing it.

In this case, dynamic confinement means denoted by references 14*a*, 14*b* and 14*c* are inserted between each pair of adjacent communicating zones. More precisely, dynamic confinement means 14*a* are inserted between zone 10*a* and buffer zone 12 which leads into zone 10*a*, the dynamic confinement means 14*c* are inserted between each pair of adjacent buffer zones 12 and dynamic confinement means 14*b* are inserted between zone 10*b* and buffer zone 12 that leads into this buffer zone.

Dynamic confinement means 14*a*, 14*b* and 14*c* are identical with each other and they may be made as described above with reference to FIG. 1, or as described above with reference to FIG. 2, depending on the case.

As described above, the air curtains formed by the dynamic confinement means 14*a* and 14*b* separating zones 10*a* and 10*b* are delimited at the sides by side walls 22 of the buffer zones considered which extend into zones 10*a* and 10*b*, so as to have a width equal to at least the maximum thickness of the air curtains considered.

On the other hand, the air curtains formed by dynamic confinement means 14*c* that separate two consecutive buffer zones 12 are delimited at the sides by extensions of the side walls 22 of these buffer zones over a width equal to the width of the supply nozzles forming these air curtains.

As illustrated as an example in the case of the central buffer zone 12 in FIG. 3, note that a single buffer zone can provide dynamic separation of more than two zones 10*a*, 10*b* and 10*c*. In this case, one or several openings are formed in at least one of the side walls 22 of the buffer zone considered and each of the openings is controlled by dynamic confinement means 14*d*, the characteristics of which are similar to the characteristics of the dynamic confinement means 14*a* and 14*b* in FIG. 1, or dynamic confinement means 14'*a* and 14'*b* in FIG. 2.

What is claimed is:

1. Dynamic separation device comprising:

at least one buffer zone with controlled atmospher configured to connect a first zone and a second zone;

first dynamic confinement means provided between the at least one buffer zone and the first zone to be configured to create a first air curtain between the at least one buffer zone and the first zone;

second dynamic confinement means provided between the at least one buffer zone and the second zone to be configured to create a second air curtain between the at least on buffer zone and the second zone; and each of the first and second air curtains comprising a first relatively slow clean air jet and a second relatively fast clean air jet, the first relatively slow clean air jet including a tongue which substantially separates the at least one buffer zone from the first or second zones, the second relatively fast clean air jet being configured to flow on a side of the at least on buffer zone and next to the first relatively slow clean air jet in a same direction as the first relatively slow clean air jet.

2. Device according to claim 1, in which the said first and second dynamic confinement means are such that the second jet in injected at a flow such that the air flow induced by the surface of the second jet in contact with the first jet is not more than approximately half of the first jet injection flow.

3. Device according to claim 1, in which the said first and second dynamic confinement means are such that each air curtain comprises a relatively slow third jet in the same direction as the first and second jets and adjacent to the second jet on the same side as the buffer zone, the third jet comprising a tongue that completely closes off communication between the zones and being injected at a flow significantly equal to the injection flow of the first jet, so that the air flows induced by the surfaces of the second jet in contact with the first and third jets respectively are or preferably appeoximately equal to half of the injection flows of the first and second jets.

4. Device according to claim 1, in which the said first and second dynamic confinement means comprise at least two adjacent air supply nozzles and air intake grills which face the air supply nozzles, the air supply nozzles and the air intake grilles being located in two parallel planes, respectively.

5. Device according to claim 4, in which the supply nozzles and the intake grilles are located in line with an upper surface and a lower surface of the buffer zone.

6. Device according to claim 1 in which the buffer zone comprises ventilation associated with injection means, outputting clean air into the buffer zone at a flow equal to at least half the sum of the air flows induced by each of the surfaces of the air curtain jets in contact with the buffer zone, the injection flows being such that it creates a minimum speed of 0.1 m/s across the areas of the planes at the ends of the buffer zone.

7. Device according to claim 6, in which the ventilation comprises a blower ceiling.

8. Device according to claim 6, in which the buffer zone comprises an intake grille distributed over its entire lower surface, the flow of the injection means being equal to at least the sum of the air flew at the intake grille and the air flow induced by each surface of the air curtain jets in contact with the buffer zone.

9. Device according to claim 1, in which several buffer zones consisting of side walls, are place in series between the zones to be separated, the air cutains inserted between two buffer zones being delimited by the continuity of the side walls and the air curtains inserted between a buffer zone and one of the the zones to be separated are extended by the side walls with a width equal to at least the maximum thickness of these air curtains.

10. Device according to claim 1, in which a single buffer zone composed of side walls is inserted between the zones to be separated, the air curtains being extended by a part of the side walls with a width equal to at least the maximun thickness of these air curtains.

* * * * *